US005733116A

United States Patent [19]

Tanno et al.

[11] Patent Number: 5,733,116

[45] Date of Patent: Mar. 31, 1998

[54] HEAT TREATMENT APPARATUS

[75] Inventors: Yoshiyuki Tanno; Hiroshi Shimura; Sigemi Yamaguchi, all of Tokyo, Japan

[73] Assignee: Dowa Mining Co., Ltd., Tokyo, Japan

[21] Appl. No.: 770,169

[22] Filed: Dec. 19, 1996

[30] Foreign Application Priority Data

Dec. 28, 1995 [JP] Japan ..... 7-352343

[51] Int. Cl.[6] ..... F27D 3/00

[52] U.S. Cl. ..... 432/244; 432/242; 432/243; 432/239; 432/250; 110/181; 414/156

[58] Field of Search ..... 432/243, 244, 432/239, 242, 250; 110/176, 177, 178, 181; 414/156, 194, 198, 17, 18

[56] References Cited

U.S. PATENT DOCUMENTS

| | | | |
|---|---|---|---|
| 4,455,177 | 6/1984 | Filippov et al. | 148/155 |
| 4,579,523 | 4/1986 | Laiquddin et al. | 432/2 |
| 4,582,301 | 4/1986 | Wunning | 266/87 |
| 4,741,695 | 5/1988 | Ushijima | 414/156 |
| 5,225,144 | 7/1993 | Nanba et al. | 266/251 |
| 5,435,686 | 7/1995 | Canner | 414/156 |

FOREIGN PATENT DOCUMENTS

| | | |
|---|---|---|
| 55-128577/1980 | 3/1979 | Japan . |
| 57-21866/1987 | 2/1982 | Japan . |
| 59-38870/1989 | 12/1984 | Japan . |
| 2-51904/1994 | 7/1990 | Japan . |
| 6-49621/1994 | 8/1991 | Japan . |

*Primary Examiner*—Henry A. Bennett
*Assistant Examiner*—Jiping Lu
*Attorney, Agent, or Firm*—Nilles & Nilles SC

[57] ABSTRACT

A heat treatment apparatus having a heat treatment furnace into which a hydrocarbon gas and an oxidization gas are introduced, wherein an outlet opening of a valve through which a pusher for pushing a work to be heat treated in the heat treatment furnace is movable is hermetically connected to a pusher insertion port formed on a wall of the heat treatment furnace, and a seal box is connected hermetically to an inlet opening of the valve, the pusher being movable hermetically through the seal box. An elevator door for opening and closing the heat treatment furnace has a guide pin projected therefrom, and a jam having an upper hook surface for receiving the guide pin thereon, the jam being pivotally supported so that when the elevator door is lowered, the elevator door is moved by the jam toward a seal surface of the opening of the heat treatment furnace. A guide groove for guiding a pin of an elevator door in the vertical direction is curved at the lower portion thereof toward a seal surface of the opening of the heat treatment furnace. A seal packing is provided on a seal surface of an opening of the heat treatment furnace, and a cooling pipe is provided near the seal packing.

11 Claims, 8 Drawing Sheets

HEAT TREATMENT APPARATUS

BACKGROUND OF THE INVENTION

1. Field of the Invention

This invention relates to a heat treatment apparatus, and more particularly relates to a heat treatment apparatus having a heat treatment furnace into which a hydrocarbon gas and an oxidization gas are introduced in order to heat treating metals.

2. Description of the Prior Art

FIG. 7 shows a conventional batch furnace. In FIG. 7, a reference numeral 1 denotes a heating room, 2 denotes a cooling room, 3 an entrance door for said heating room 1, 3*a* an opening and closing port formed on said entrance door 3, 4 an intermediate door, 4*a* an outlet formed on said intermediate door 4, 5 an outlet door for said cooling room 2, 6 a cooling oil tank, 7 an excess air exhausting device, 8 a curtain flame to be ignited when the outlet door 5 is opened, 9 and 10 gas supply pipes, 11 and 12 valves provided in said gas supply pipes 9 and 10, respectively, and 19 an agitating fan.

FIG. 8 shows a conventional continuous furnace and parts of the furnace which are similar to the corresponding parts of the furnace shown in FIG. 7 have been given corresponding reference numerals and need not be further described.

A reference numeral 15 denotes a work receiving room, 16 a door for the work receiving room 15, 17 a $CO_2$ supply pipe, 18 is valve provided in said $CO_2$ supply pipe 17, and 20 a gas material supply pipe.

In the conventional cementation method, a converted gas obtained from the conversion furnace is used as a carrier gas. Recently, in order to enhance the quality, and to reduce the treatment time and running cost, such a method that the conversion furnace is not used, but a hydrocarbon gas and an oxidizing gas are introduced directly into the furnace to carry out the metamorphism and the cementation in the furnace has been proposed. Further, such a cementation method that the carbon potential in the furnace atmosphere is increased and decreased repeatedly to reduce the treatment time is described in Japanese Patent Laid Open Nos. 128577/1980 and 49621/1994, Japanese Patent Publication Nos. 38870/1989, 51904/1994 and 21866/1987, for example.

FIG. 9 shows a heat treatment furnace in said Japanese Patent Publication No. 21866/1987, wherein the entrance door 3 is opened at first, and then a work is inserted into a vestibule 22 by a pusher 21.

When the pusher 21 is returned, the entrance door 3 is closed and at the same time a door 24 is opened and then the work is moved into the heating room 1 by a pusher 23.

Next, the door 24 is closed and after the heating treatment is completed a door 26 is opened and the work is moved by a pusher 25 into the cooling room 2. Then, the door 26 is closed and the temperature in the cooling room 2 is reduced, and at the same time the intermediate door 4 is opened and the work is moved by a pusher 27 into the cooling oil tank 6. Then, the intermediate door 4 is closed to carry out the quenching. Next, the outlet door 5 is opened, and the work is discharged to the outside, and then the outlet door 5 is closed.

However, the conventional heat treatment apparatus for metals using an endothermic gas has such a defect that it is difficult to form a hermetical seal of the apparatus.

SUMMARY OF THE INVENTION

An object of the present invention is to obviate the above defect of the conventional heat treatment apparatus.

According to the invention in one of its aspects, a heat treatment apparatus comprises a valve having an outlet opening and an inlet opening through which a pusher for pushing a work to be heat treated in said heat treatment furnace is movable, said outlet opening of the valve being hermetically connected to a pusher inserting port formed on a wall of said heat treatment furnace, and a seal box hermetically connected to said inlet opening of the valve, said pusher being movable hermetically through said seal box.

According to other aspects of the invention, said valve is closed when said pusher is withdrawn therefrom, and is opened when said pusher is inserted thereinto.

According to another aspect of the invention, the heat treatment apparatus further comprises an elevator door for opening and closing an opening of said heat treatment furnace, a guide pin projected from said elevator door, and a jam having an upper hook surface for receiving said guide pin thereon, said jam being pivotally supported so that when said elevator door is lowered, said elevator door is moved by said jam toward a seal surface of an opening of said heat treatment furnace.

In accordance with the invention in another of its aspects, the heat treatment apparatus further comprises an elevator door for opening and closing an opening of said heat treatment furnace, a guide pin projected from said elevator door, and a guide groove for guiding said pin in the vertical direction, wherein a lower end portion of said groove is curved toward a seal surface of an opening of said heat treatment furnace.

According to yet other aspects of the invention, a seal packing is provided on a seal surface of an opening of said heat treatment furnace, and a cooling pipe is provided near said seal packing.

The foregoing and other objects, features, and advantages of the present invention will become apparent from the following more particular description of a preferred embodiment of the invention, as illustrated in the accompanying drawings.

DESCRIPTION OF THE PREFERRED EMBODIMENT

Figure 1:
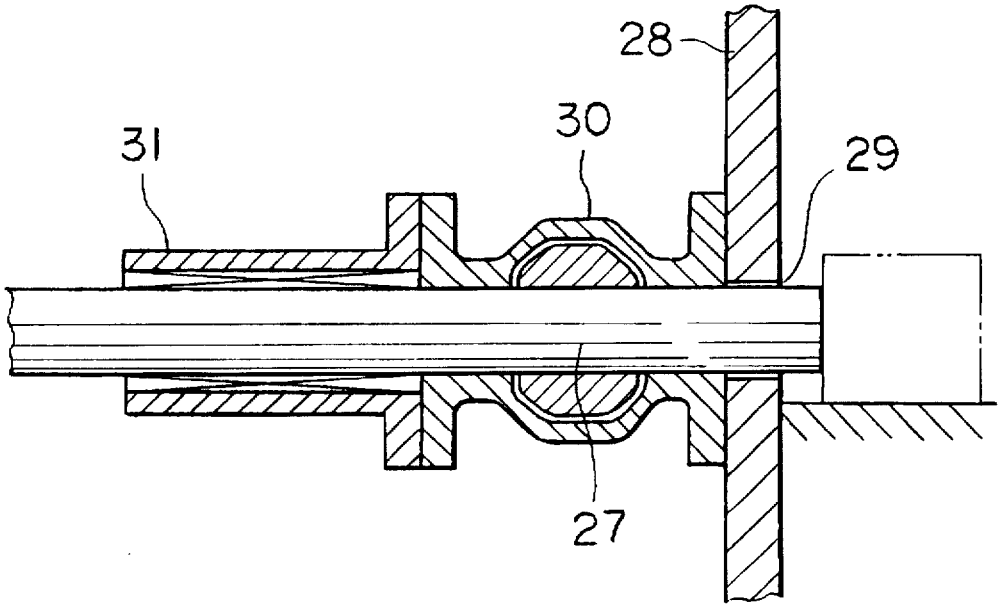
FIG. 1 is a sectional side view of a hermetical seal of a pusher portion of a heat treatment apparatus in accordance with the present invention.
Figure 9:
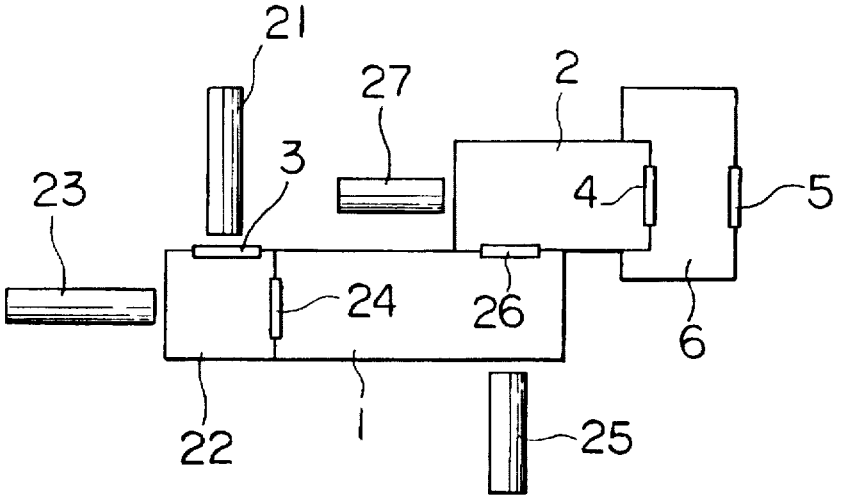
FIG.9 PRIOR ART
FIG. 9 is a sectional side view of the other conventional continuous furnace.

FIG. 1 shows an improved hermetical seal for one 27 of the pushers 28, 25 and 27 shown in FIG. 9. In FIG. 1, a ball valve 30 and a seal box 31 are arranged in this order adjacent to the outer surface of a furnace wall 28 of the room 1 or 2 corresponding to a pusher insertion port 29 formed on the furnace wall 28. The pusher 27, for example, can be moved passing through said seal box 31, ball valve 30 and pusher insertion port 29 and inserted into the cooling room 2, for example.

In this embodiment of the present invention, a work to be heat treated is inserted into the room 2 by the pusher 27 in the state that the ball valve 30 is opened, then the pusher 27 is withdrawn from the room 2 through the ball valve 30 into the seal box 31, and then the ball valve 30 is closed. As stated above, according to the present invention, the work can be inserted into the room 2 without breaking the hermetical seal of the room 2.

Figure 2:
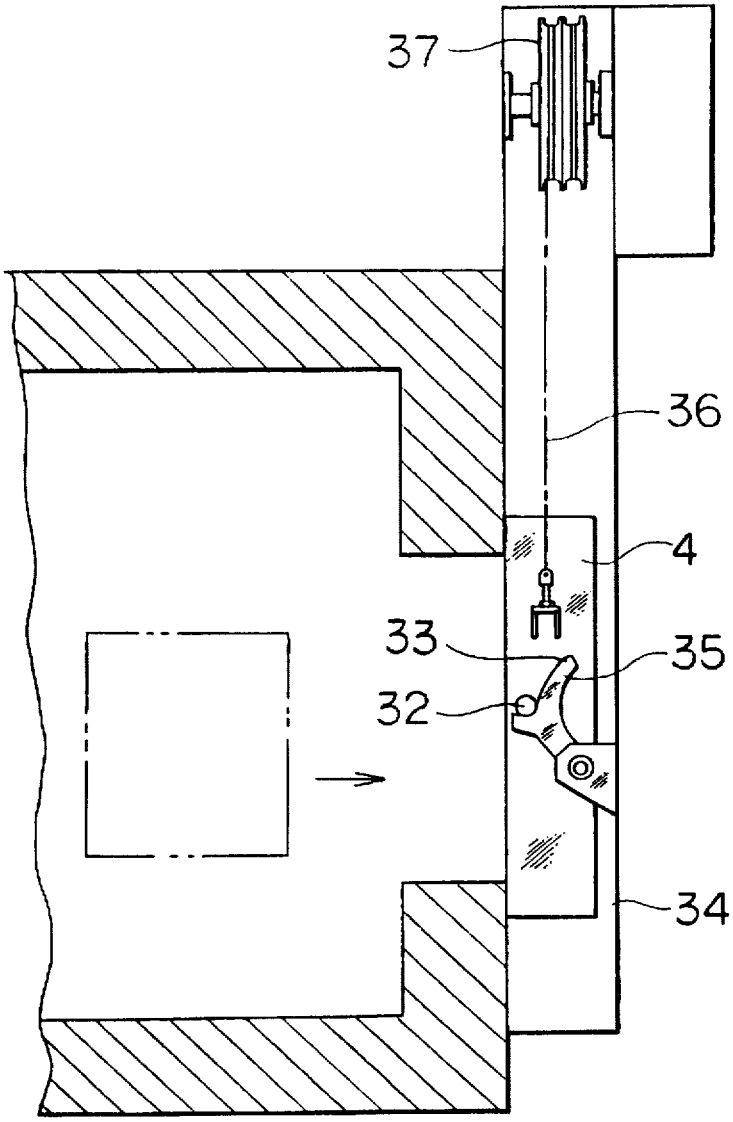
FIG. 2 is a sectional side view of an intermediate door portion of the heat treatment apparatus.
Figure 3:
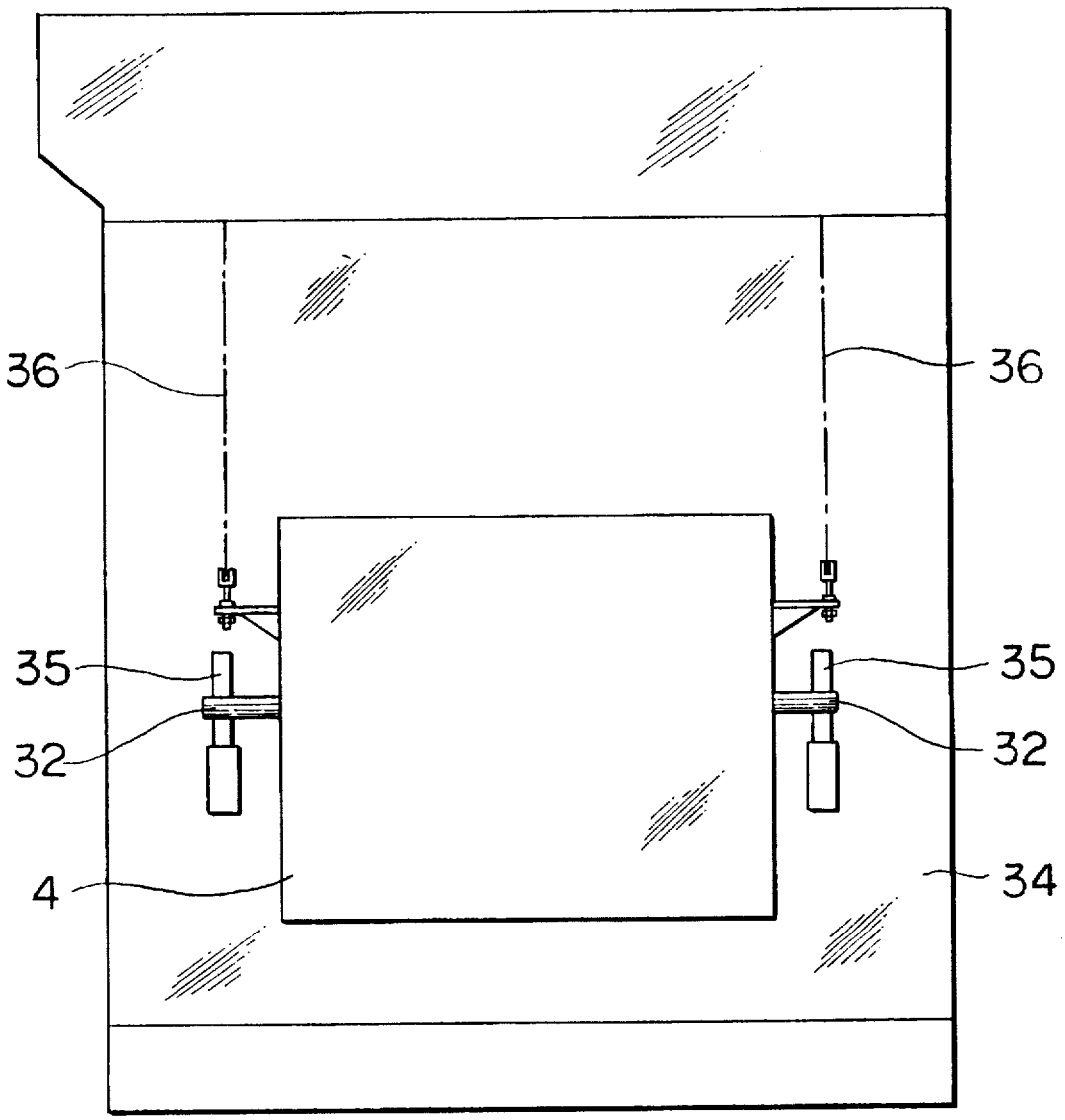
FIG. 3 is a front view of the intermediate door portion.
Figure 4:
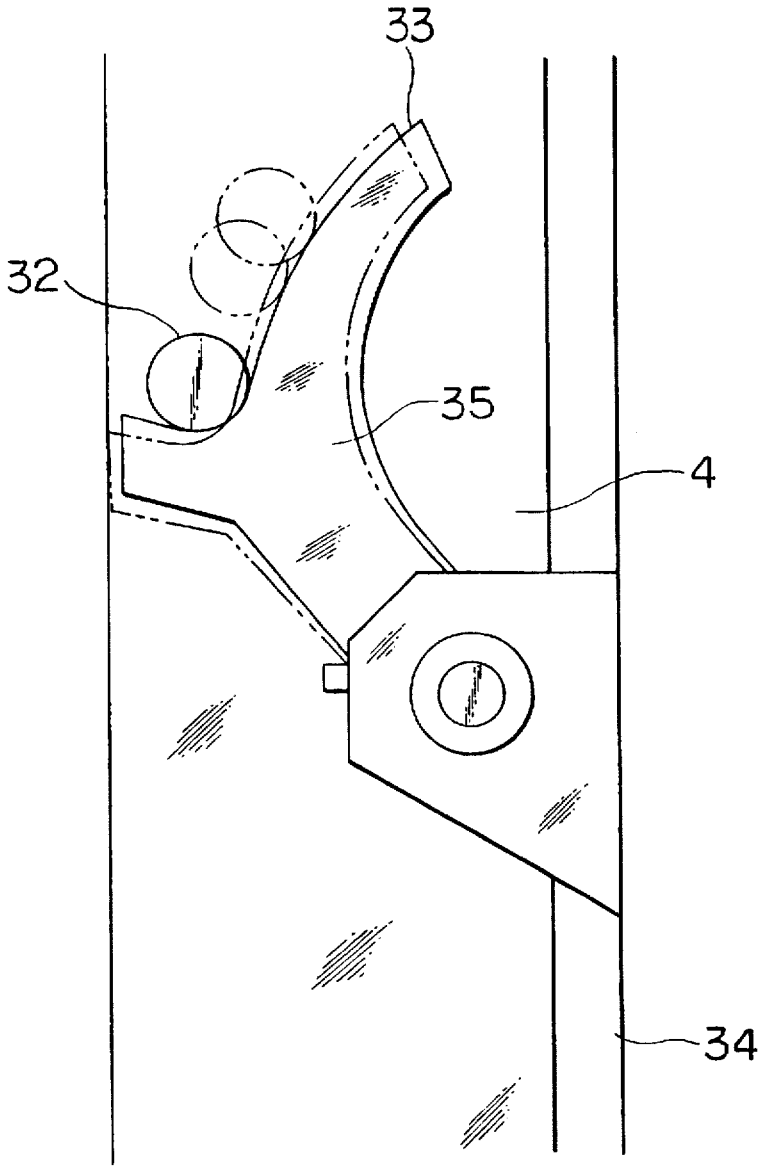
FIG. 4 is an enlarged side view of a guide means for the door.

FIGS. 2 to 4 show one of the doors 4, 24 and 26, for example, the intermediate door 4 in the heat treatment apparatus of the present invention. In the present invention, guide pins 32 are projected in the horizontal direction from both sides of the door 4, planar jams 35 each having an upper hook surface 33 for receiving said guide pin 32 and a lower portion pivotally supported by a frame 34 are provided, and the intermediate door 4 is moved up and down through chains 36 by an elevator device 37, so that when the intermediate door 4 is lowered in order to close the outlet of the room 2, the guide pins 32 of the intermediate door 4 are engaged with the upper portions of the hook surfaces 33 of the jams 35 and guided along the hook surfaces 33 leftwords in FIG. 4. After the guide pins 32 are reached to the bottom portions of the hook surfaces 33 of the jams 35, the jams 35 are rotated in the counter-clockwise direction as shown by a double dot-and-dush line in FIG. 4, so that the surface of the intermediate door 4 is pressed to the seal surface of the room 2.

According to the embodiment of the present invention, the intermediate door 4 does not contact with the seal surface of the room 2 in the course of lowering and lifting, and only when the intermediate door 4 is reached to the lowest position, the intermediate door 4 is in contact with the seal surface of the room 2, so that the seal surface is never damaged when the door is moved up and down.

Figure 5:
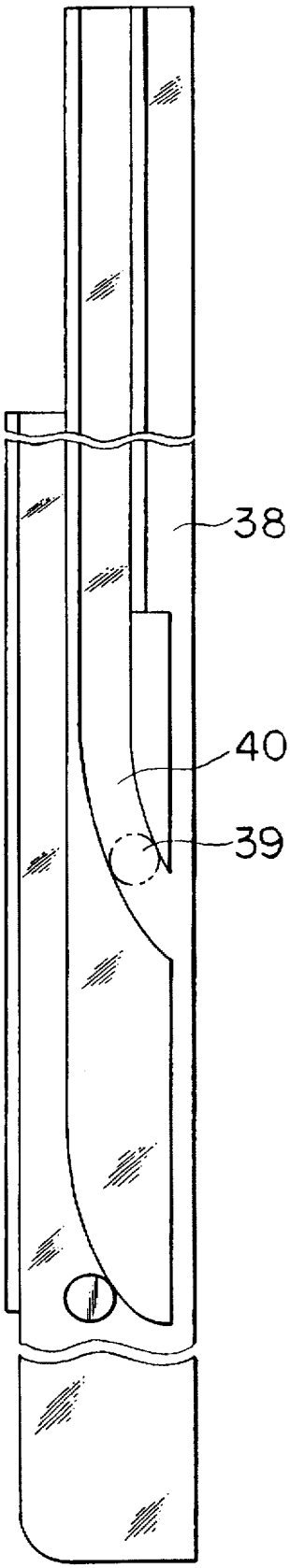
FIG. 5 is an enlarged side view of a guide means for an entrance door of the heat treatment apparatus.

FIG. 5 shows one of guide grooves 40 formed on a frame 38 for the entrance door 3 or the outlet door 5. In the present invention, guide pins 39 are projected in the horizontal direction from both sides of the door, and guided by guide grooves 40, respectively. Each of said grooves 40 is curved at the lower portion thereof toward the seal surface of the room 1 or the room 2.

According to this embodiment of the present invention, the door does not contact with the seal surface of the heating room 1 or cooling room 2 in the course of lowering and lifting, and only when the door is reached to the lowest position, the door is brought into contact with the seal surface, so that the seal surface is never damaged when the door is moved up and down.

Figure 6:
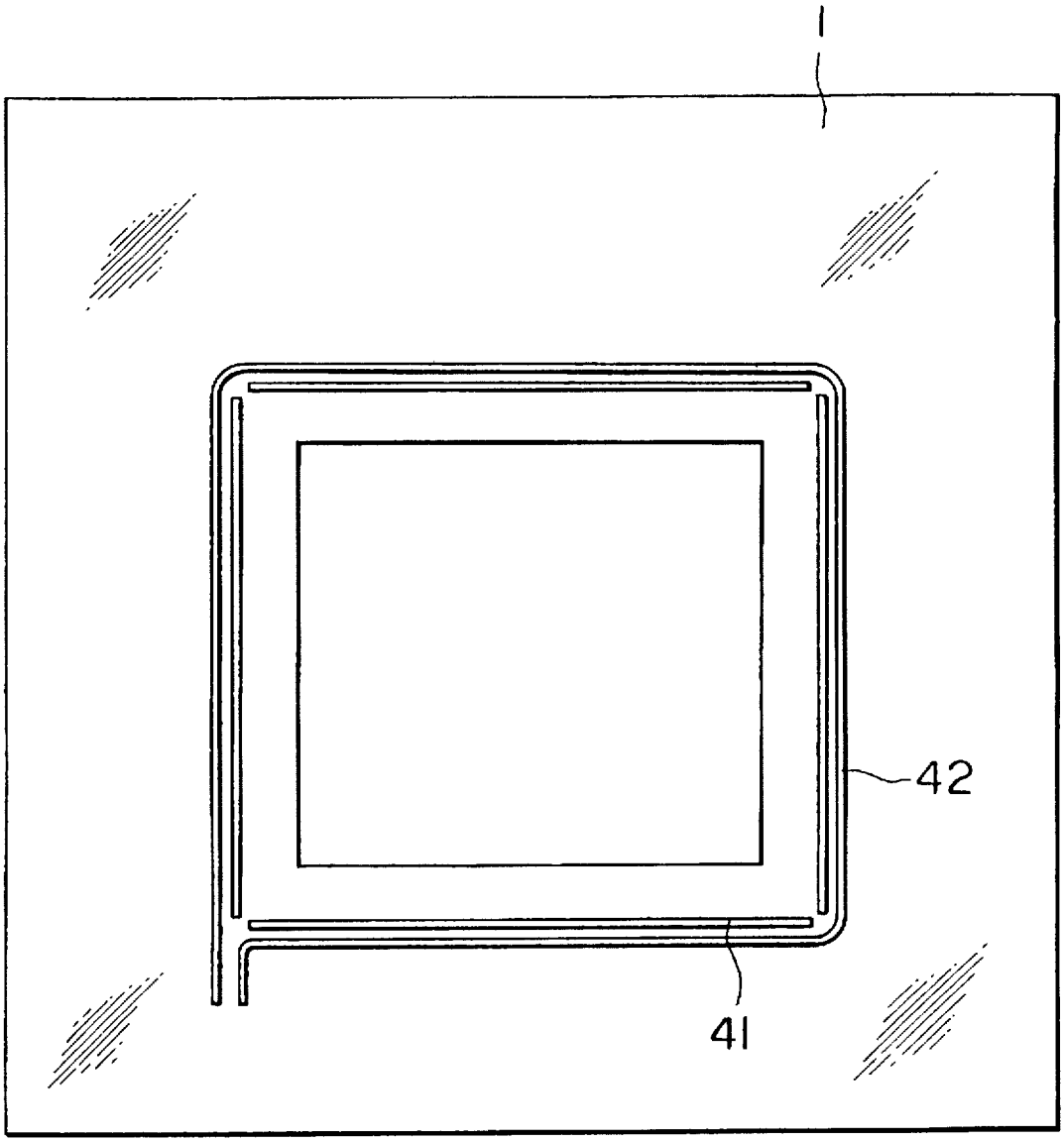
FIG. 6 is a front view of a seal portion of an opening of the heat treatment apparatus.
Figure 7:
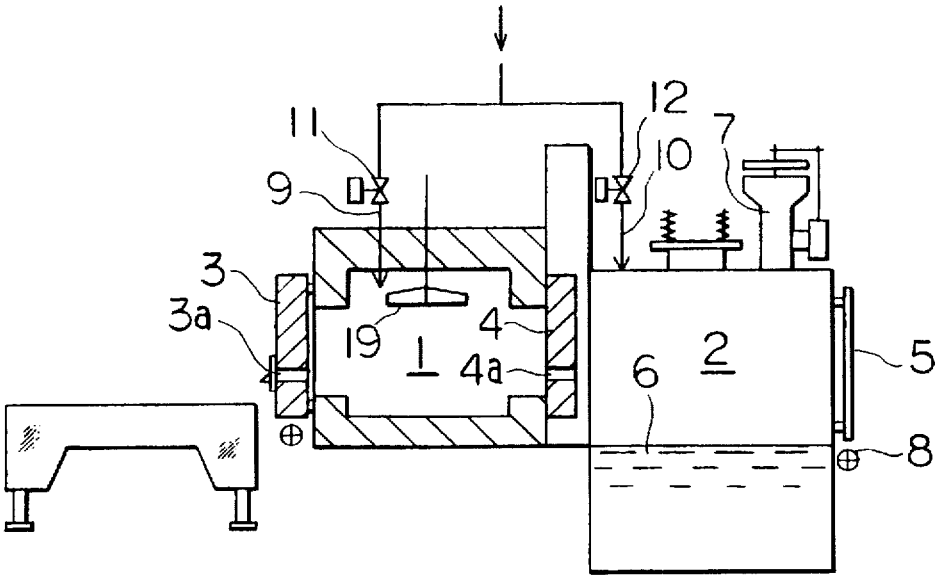
FIG.7 PRIOR ART
FIG. 7 is a sectional side view of a conventional batch furnace.
Figure 8:
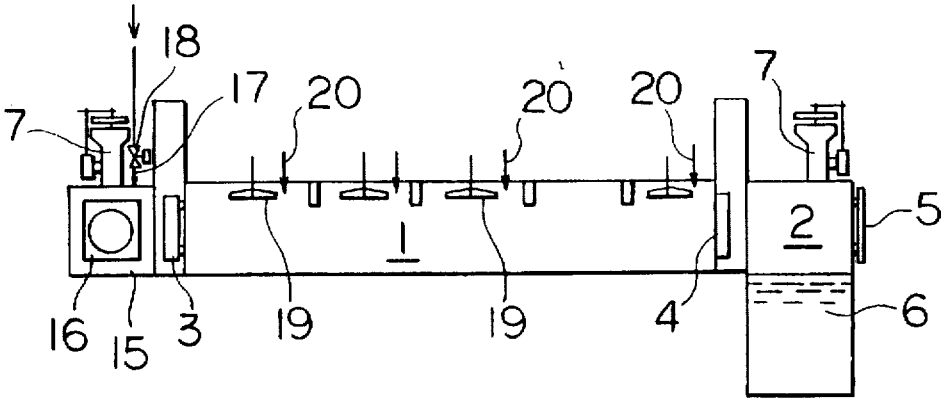
FIG.8 PRIOR ART
FIG. 8 is a sectional side view of a conventional continuous furnace.

FIG. 6 shows seal packing 41 arranged on the seal surface of the heating room 1. In the present invention, the seal packing 41 are surrounded with an air pipe 42 into which a cooling air is introduce d so as to cool the seal packing 41.

According to this embodiment of the present invention, the seal packing can be prevented from being deteriorated.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. In a heat treatment apparatus having a heat treatment furnace into which a hydrocarbon gas and an oxidization gas are introduced, the improvement characterized by comprising a valve having an outlet opening and an inlet opening through which a pusher for pushing a work to be heat treated in said heat treatment furnace is movable, said outlet opening of the valve being hermetically connected to a pusher inserting port formed on a wall of said heat treatment furnace, and a seal box hermetically connected to said inlet opening of the valve, said pusher being movable hermetically through said seal box.

2. The heat treatment apparatus as claimed in claim 1, wherein said valve is closed when said pusher is withdrawn therefrom, and is opened when said pusher is inserted thereinto.

3. The heat treatment apparatus as claimed in claim 2, further comprising an elevator door for opening and closing an opening of said heat treatment furnace, a guide pin projected from said elevator door, and a jam having an upper hook surface for receiving said guide pin thereon, said jam being pivotally supported so that when said elevator door is lowered, said elevator door is moved by said jam toward a seal surface of the opening of said heat treatment furnace.

4. The heat treatment apparatus as claimed in claim 2, further comprising an elevator door for opening and closing an opening of said heat treatment furnace, a guide pin projected from said elevator door, and a guide groove for guiding said pin in the vertical direction, wherein a lower end portion of said groove is curved toward a seal surface of an opening of said heat treatment furnace.

5. The heat treatment apparatus as claimed in claim 2, further comprising a seal packing provided on a seal surface of an opening of said heat treatment furnace, and a cooling pipe is provided near said seal packing.

6. The heat treatment apparatus as claimed in claim 1, further comprising an elevator door for opening and closing an opening of said heat treatment furnace, a guide pin projected from said elevator door, and a jam having an upper hook surface for receiving said guide pin thereon, said jam being pivotally supported so that when said elevator door is lowered, said elevator door is moved by said jam toward a seal surface of the opening of said heat treatment furnace.

7. The heat treatment apparatus as claimed in claim 3, further comprising an elevator door for opening and closing an opening of said heat treatment furnace, a guide pin projected from said elevator door, and a guide groove for guiding said pin in the vertical direction, wherein a lower end portion of said groove is curved toward a seal surface of an opening of said heat treatment furnace.

8. The heat treatment apparatus as claimed in claim 6, further comprising a seal packing provided on a seal surface of an opening of said heat treatment furnace, and a cooling pipe is provided near said seal packing.

9. The heat treatment apparatus as claimed in claim 1, further comprising an elevator door for opening and closing an opening of said heat treatment furnace, a guide pin projected from said elevator door, and a guide groove for guiding said pin in the vertical direction, wherein a lower end portion of said groove is curved toward a seal surface of an opening of said heat treatment furnace.

10. The heat treatment apparatus as claimed in claim 9, further comprising a seal packing provided on a seal surface of an opening of said heat treatment furnace, and a cooling pipe is provided near said seal packing.

11. The heat treatment apparatus as claimed in claim 1, further comprising a seal packing provided on a seal surface of an opening of said heat treatment furnace, and a cooling pipe is provided near said seal packing.

* * * * *